US011649010B1

(12) United States Patent
Hartman

(10) Patent No.: US 11,649,010 B1
(45) **Date of Patent: *May 16, 2023**

(54) APPARATUSES AND METHODS FOR PUMPS, PUMP ADAPTERS, AND PUMP ASSEMBLIES

(71) Applicant: Skier's Choice, Inc., Maryville, TN (US)

(72) Inventor: Richard Lawrence Hartman, Twin Lakes, ID (US)

(73) Assignee: Skier's Choice, Inc., Maryville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/735,049

(22) Filed: May 2, 2022

Related U.S. Application Data

(63) Continuation of application No. 17/572,933, filed on Jan. 11, 2022, now Pat. No. 11,358,680, which is a continuation of application No. 17/008,082, filed on Aug. 31, 2020, now Pat. No. 11,535,347, which is a continuation of application No. 15/296,621, filed on Oct. 18, 2016, now Pat. No. 10,759,507, which is a continuation of application No. 14/450,828, filed on Aug. 4, 2014, now Pat. No. 9,499,242, which is a (Continued)

(51) Int. Cl.

| | |
|---|---|
| ***B63B 13/00*** | (2006.01) |
| ***B63B 32/40*** | (2020.01) |
| ***B63B 1/16*** | (2006.01) |
| ***B63B 39/03*** | (2006.01) |
| ***B63B 43/06*** | (2006.01) |

(52) U.S. Cl.
CPC ..... *B63B 13/00* (2013.01); *B63B 1/16* (2013.01); *B63B 32/40* (2020.02); *B63B 39/03* (2013.01); *B63B 43/06* (2013.01)

(58) Field of Classification Search
CPC ..... B63B 13/00; B63B 32/40; B63B 1/00; B63B 1/16; B63B 39/00; B63B 39/03; B63B 43/00; B63B 43/06
USPC ..... 137/1
See application file for complete search history.

(56) References Cited

U.S. PATENT DOCUMENTS 2,635,546 A 4/1953 Enyeart et al.
4,789,307 A * 12/1988 Sloan ..... F04B 53/00 417/40

(Continued)

FOREIGN PATENT DOCUMENTS

| | | | |
|---|---|---|---|
| EP | 1042611 | B1 | 3/2000 |
| GB | 2046361 | A | 11/1980 |
| WO | 2004055374 | A1 | 7/2004 |

*Primary Examiner* — Lars A Olson
(74) *Attorney, Agent, or Firm* — Malhotra Law Firm, PLLC; Deepak Malhotra

(57) ABSTRACT

A pump intake adapter for pumping shallow levels of fluid from a surface to be drained, the pump intake adapter including a connection on the pump intake adapter to convey the fluid away from the pump intake adapter; an intake surface on the pump intake adapter; and a portion of the intake surface of the pump intake adapter that in operation does not contact the surface to be drained, and creates an open conduit between the pump intake adapter and the surface to be drained through which fluid may flow, the open conduit being in fluid communication with the connection on the pump intake adapter. Other systems and methods are provided.

20 Claims, 13 Drawing Sheets

Related U.S. Application Data continuation of application No. 13/543,686, filed on Jul. 6, 2012, now Pat. No. 8,798,825.

(56) References Cited

U.S. PATENT DOCUMENTS

| | | | | |
|---|---|---|---|---|
| 5,134,079 | A * | 7/1992 | Cusack | G01N 35/08 436/52 |
| 5,467,643 | A | 11/1995 | Barnett et al. | |
| 6,534,940 | B2 | 3/2003 | Bell | |
| 8,798,825 | B1 | 8/2014 | Hartman | |
| 9,499,242 | B2 | 11/2016 | Hartman | |
| 9,689,395 | B2 | 6/2017 | Hartman | |
| 9,828,075 | B1 | 11/2017 | Hartman | |
| 9,873,491 | B2 | 1/2018 | Hartman | |
| 9,919,766 | B2 | 3/2018 | Daley et al. | |
| 9,950,771 | B1 | 4/2018 | Hartman | |
| 10,093,398 | B1 | 10/2018 | Hartman | |
| 10,246,170 | B2 | 4/2019 | Venables et al. | |
| 10,302,090 | B2 | 5/2019 | Moormann et al. | |
| 10,329,004 | B2 | 6/2019 | Hartman | |
| 10,435,122 | B2 | 10/2019 | Hartman | |
| 10,533,549 | B1 | 1/2020 | Bush | |
| 10,759,507 | B2 | 9/2020 | Hartman | |
| 2010/0166570 | A1 | 7/2010 | Hampton | |
| 2016/0097393 | A1 | 4/2016 | Hartman | |
| 2017/0036743 | A1 | 2/2017 | Hartman | |
| 2019/0353512 | A1 | 11/2019 | Durfee et al. | |
| 2020/0010158 | A1 | 1/2020 | Hartman | |
| 2020/0017175 | A1 | 1/2020 | Hartman | |

* cited by examiner side view top view side view bottom view

APPARATUSES AND METHODS FOR PUMPS, PUMP ADAPTERS, AND PUMP ASSEMBLIES

CROSS REFERENCE TO RELATED APPLICATION

This is a continuation of U.S. patent application Ser. No. 17/572,933, filed Jan. 11, 2022, which is a continuation of U.S. patent application Ser. No. 17/008,082, filed Aug. 31, 2020, which is a continuation of U.S. patent application Ser. No. 15/296,621, filed Oct. 18, 2016, now U.S. Pat. No. 10,759,507, which is a continuation of U.S. patent application Ser. No. 14/450,828, filed Aug. 4, 2014, now U.S. Pat. No. 9,499,242, which in turn is a continuation of U.S. patent application Ser. No. 13/543,686, filed Jul. 6, 2012, now U.S. Pat. No. 8,798,825, all of which are incorporated herein by reference.

TECHNICAL FIELD

The present disclosure relates generally to equipment traditionally used on watercraft. Embodiments of the disclosure relate to the operation and management of bilge pumping systems aboard watercraft.

BACKGROUND

Watersports involving powered watercraft have enjoyed a long history. Water skiing's decades-long popularity spawned the creation of specialized watercraft designed specifically for the sport. Such "skiboats" are optimized to produce very small wakes in the water behind the watercraft's hull, thereby providing the smoothest possible water to the trailing water skier.

More recently, watersports have arisen which actually take advantage of, and benefit from, the wake produced by a watercraft. Wakeboarding, wakeskating, and kneeboarding all use the watercraft's wake to enable the participants to perform various maneuvers or "tricks" including becoming airborne.

As with water skiing, specialized watercraft known as "wakeboats" have been developed for these sports. Present-day wakeboats and skiboats are often up to 30 feet in hull length with accommodation for up to 30 passengers. Contrary to skiboats, however, wakeboats seek to enhance the wake produced by the hull using a variety of techniques. The wakes available behind some modern wakeboats have become so large and developed that it is now even possible to "wakesurf", or ride a surfboard on the wake, without a towrope or other connection to the watercraft whatsoever.

Improvements to wakeboats and skiboats and the safety of their operation would be very advantageous to the fast-growing watersports market and the watercraft industry in general.

SUMMARY

Watercraft bilge pump adapters are provided that can allow bilge pumps to more completely drain accumulated fluids from interior compartments.

Watercraft bilge pump adapters are also provided that accommodate a variety of bilge shapes and profiles.

Watercraft bilge pump monitoring systems are provided that include advanced pump monitoring, detection of water to be pumped, and detection of certain bilge pump failure modes.

Some embodiments provide a pump intake adapter for pumping shallow levels of fluid from a surface to be drained, the pump intake adapter including a connection on the pump intake adapter to convey the fluid; an intake surface on the pump intake adapter; and a portion of the intake surface of the pump intake adapter that in operation does not contact the surface to be drained, and creates an open conduit between the pump intake adapter and the surface to be drained through which fluid may flow, the open conduit being in fluid communication with the connection on the pump intake adapter

BRIEF DESCRIPTION OF THE VIEWS OF THE DRAWINGS

Embodiments of the disclosure are described below with reference to the following accompanying drawings.

DETAILED DESCRIPTION OF THE ILLUSTRATED EMBODIMENTS

Figure 1:
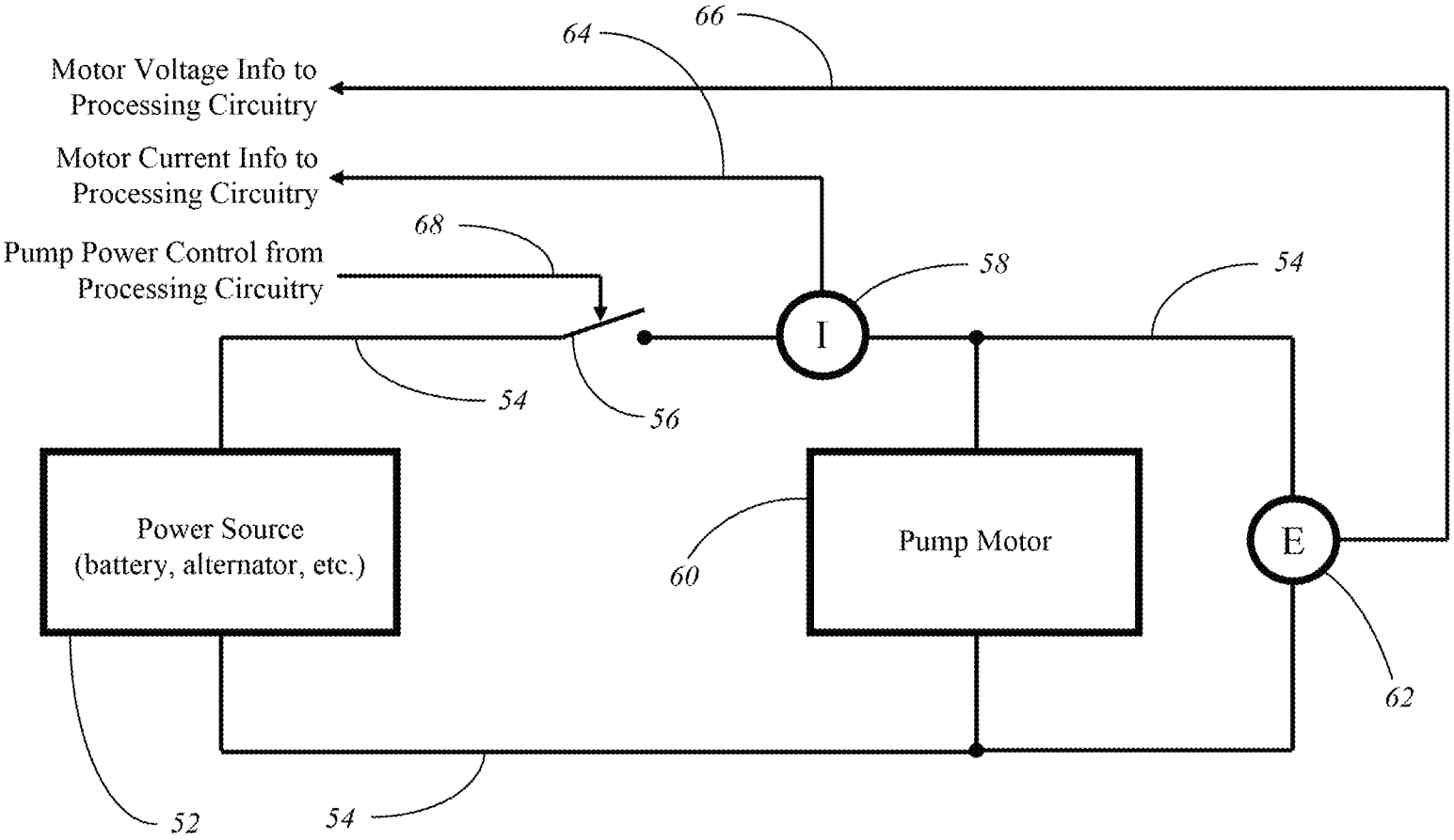
FIG. 1 is a block diagram of a pump configured with voltage and current measurement, a power source, circuit interrupters, and associated electrical interconnections.

This disclosure is submitted in furtherance of the constitutional purposes of the U.S. Patent Laws "to promote the progress of science and useful arts" (Article 1, Section 8).

The assemblies and methods of the present disclosure will be described with reference to FIGS. 1-17.

Participants in the sports of wakeboarding, wakesurfing, wakeskating, and the like often have different needs and preferences with respect to the size, shape, and orientation of the wake behind a wakeboat. A variety of schemes for creating, enhancing, and controlling a wakeboat's wake have been developed and marketed with varying degrees of success.

For example, many different wakeboat hull shapes have been proposed and produced. Another approach known in the art is to use a "fin" or "scoop" behind and below the wakeboat's transom to literally drag the hull deeper into the water. Yet another system involves "trim plates": control surfaces generally attached via hinges to the wakeboat's transom, whose angle relative to the hull can be adjusted to "trim" the attitude of the hull in the water. The angles of trim plates are often controlled by electric or hydraulic actuators, permitting them to be adjusted with a switch or other helm-accessible control.

One goal of such systems is to cause the wakeboat's hull to displace greater amounts of water, thus causing a larger wake to form as the water naturally seeks to restore equilibrium after the hull has passed. Another goal is to finely tune the shape, location, and behavior of the wake to best suit the preferences of each individual participant.

The predominant system has evolved to include specialized hull shapes, trim plates, and water as a ballast medium to change the position and attitude of the wakeboat's hull in the water. Water chambers are installed in various locations within the wakeboat, and one or more pumps are used to fill and empty the chambers. The resulting ballast system enables the amount and distribution of weight within the watercraft to be controlled and adjusted.

Improved embodiments of wakeboat ballast systems have involved placing the ballast sacks in out-of-the-way compartments, the occasional use of hardsided tanks as opposed to flexible sacks, permanent installation of the fill and drain pumps and plumbing through the hull, permanent power supply wiring, and console-mounted switches that enabled the wakeboat's driver to fill and drain the various ballast chambers from a central location. Such installations became available as original equipment installed by wakeboat manufacturers themselves. They were also made available as retrofit packages to repurpose existing boats as wakeboats, or to improve the performance and flexibility of wakeboats already possessing some measure of a ballast system. These permanent or semi-permanent installations became known by the term "automated ballast systems", a misnomer because no automation was involved; while the use of switches and plumbing was certainly more convenient than loose pumps plugged into cigarette lighter outlets, their operation was still an entirely manual task.

The proliferation of wakeboat ballast systems and centralized vessel control systems has increased their popularity, but simultaneously exposed many weaknesses and unresolved limitations. For example, such so-called "automated" wakeboat ballast systems rely on ballast pump run time to estimate ballast compartment fill levels with no feedback mechanism to indicate full/empty conditions, no accommodation for air pockets or obstructions that prevent water flow, and other anomalous conditions that frequently occur. Relying solely on ballast pump run time can thus yield wildly inaccurate and unrepeatable ballasting results. So-called "automated" ballast systems thus purport to accurately restore previous conditions, when in fact they are simply making an estimate—to the frustration of participants and wakeboat operators alike.

Referring to FIG. 1, a motor for a single Fill Pump (FP) or Drain Pump (DP) is shown according to an embodiment of the disclosure. In one embodiment, a ballast pump can include an electric motor 60 operatively coupled to an electrical power source 52 such as a battery or alternator. The ballast pump may be an impeller style pump such as the Johnson Ultra Ballast Pump (Johnson Pump of America, Inc., 1625 Hunter Road, Suite B, Hanover Park Ill., 60133, United States), a centrifugal style pump such as the Rule 405FC (Xylem Flow Control, 1 Kondelin Road, Cape Ann Industrial Park, Gloucester Mass., 01930, United States), or another pump whose characteristics suit the specific application. An advantage of an embodiment of the present disclosure can be achieved using either of these pumps and/or others that possess varying degrees of similarity.

Power to ballast pump motor 60 can be controlled by circuit interrupter 56, shown as a single device for clarity but which may be one or more of a manual switch, a relay or functionally similar device controlled by control signal 68, or other components suitable for making and breaking circuit 54 manually or under system control. When circuit interrupter 56 is closed and thus circuit 54 is completed through pump motor 60, the voltage from power source 52 will be applied to pump motor 60 and current will flow through circuit 54 according to Ohm's Law.

Continuing with FIG. 1, the voltage across pump motor 60 and the current flowing in circuit 54 are affected by the physical load encountered by pump motor 60. This is due to the phenomenon known as back electromotive force or counter-electromotive force, commonly abbreviated as CEMF, wherein a rotating motor itself generates a voltage opposite to that which is powering it. CEMF is directly proportional to motor speed, so a nonrotating motor generates zero CEMF while a motor spinning at full speed generates its maximum CEMF.

While CEMF is in fact an opposition voltage generated by a motor, its real world effect is as a motor's resistance to current flow. Thus CEMF can also be conveniently described as a motor's resistance—a resistance that varies in direct proportion to the motor's speed. When a motor is first started, or when its load is so great that the motor cannot overcome it and stalls, its CEMF is zero. When the motor is able to free run without load, both speed and CEMF can reach their maximums.

For example, when circuit 54 of FIG. 1 has been open and is then closed, pump motor 60 will initially be motionless, be generating no CEMF, and thus have minimum resistance. Pump motor 60 will act as nearly a dead short and the current flowing in circuit 54 will be relatively high. Therefore, according to Ohm's Law, the voltage across (relatively low resistance) pump motor 60 will be reduced.

Once pump motor 60 of FIG. 1 begins to rotate, it also begins to generate CEMF and thus its effective resistance increases. Again according to Ohm's Law, this increased resistance reduces the current flowing in circuit 54 and increases the voltage across pump motor 60. The speed of pump motor 60 will increase until equilibrium is reached between the CEMF of pump motor 60 and the voltage of power source 52, at which time the speed of pump motor 60 will stabilize.

As shown in FIG. 1 the present disclosure can include a voltage sensor 62 to make motor voltage information available via signal 66. (The symbol "E" is used to indicate voltage in accordance with Ohm's Law.) Embedded microprocessors and other forms of processing circuitry commonly include analog inputs that detect and measure voltages. Sensor 62 can be an analog input of this type, or another voltage sensor whose characteristics suit the specific application.

As just one example, the processing circuitry of the present disclosure can comprise a PIC18F25K80 microcontroller (Microchip Technology Inc., 2355 West Chandler Boulevard, Chandler Ariz., 85224-6199, United States) or another device whose characteristics suit the specific application. The PIC18F25K80 includes multiple analog inputs that directly sense an applied voltage. In one embodiment of the present disclosure, one of these analog inputs could be used to sense the voltage across a pump motor.

Figure 15:
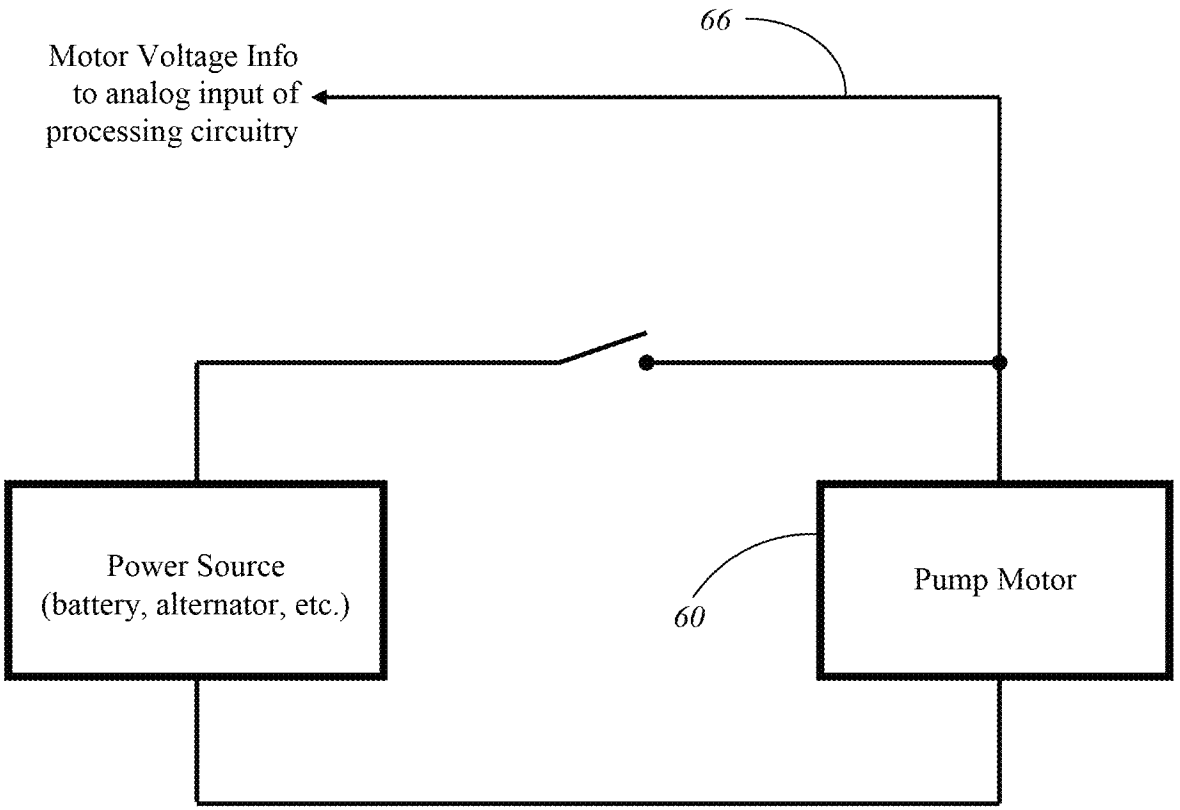
FIG. 15 is a block diagram of an analog input on a microcontroller being used to determine the voltage on the electric motor of a pump.

Again referring to FIG. 1, motor voltage info 66 could be connected to the positive side of pump motor 60 at location 62. The microcontroller would thus be able to use one of its analog inputs to measure the motor voltage info 66. A block diagram of this arrangement is shown in FIG. 15.

As shown in FIG. 1, the present disclosure also includes a current sensor 58 to make motor current information available via signal 64. (The symbol "I" is used to indicate current in accordance with Ohm's Law.) Current sensor 58 may be, for example, an ACS713 integrated conductor sensor (Allegro MicroSystems, Inc., 115 Northeast Cutoff, Worcester Mass., 01606, United States) or another device whose characteristics suit the specific application. The output of the integrated conductor sensor becomes motor current info 64 and can be applied to an analog input of the embedded microprocessors or other processing circuitry.

In another embodiment of the present disclosure, current sensor 58 may be a series resistor. According to Ohm's Law, a voltage develops across a resistor when current flows through it. The aforementioned analog inputs available on embedded microprocessors and other forms of processing circuitry may measure the voltages on either side of the resistor and, based on the voltage difference and the resistor's value, use Ohm's Law to calculate the motor current.

Figure 16:
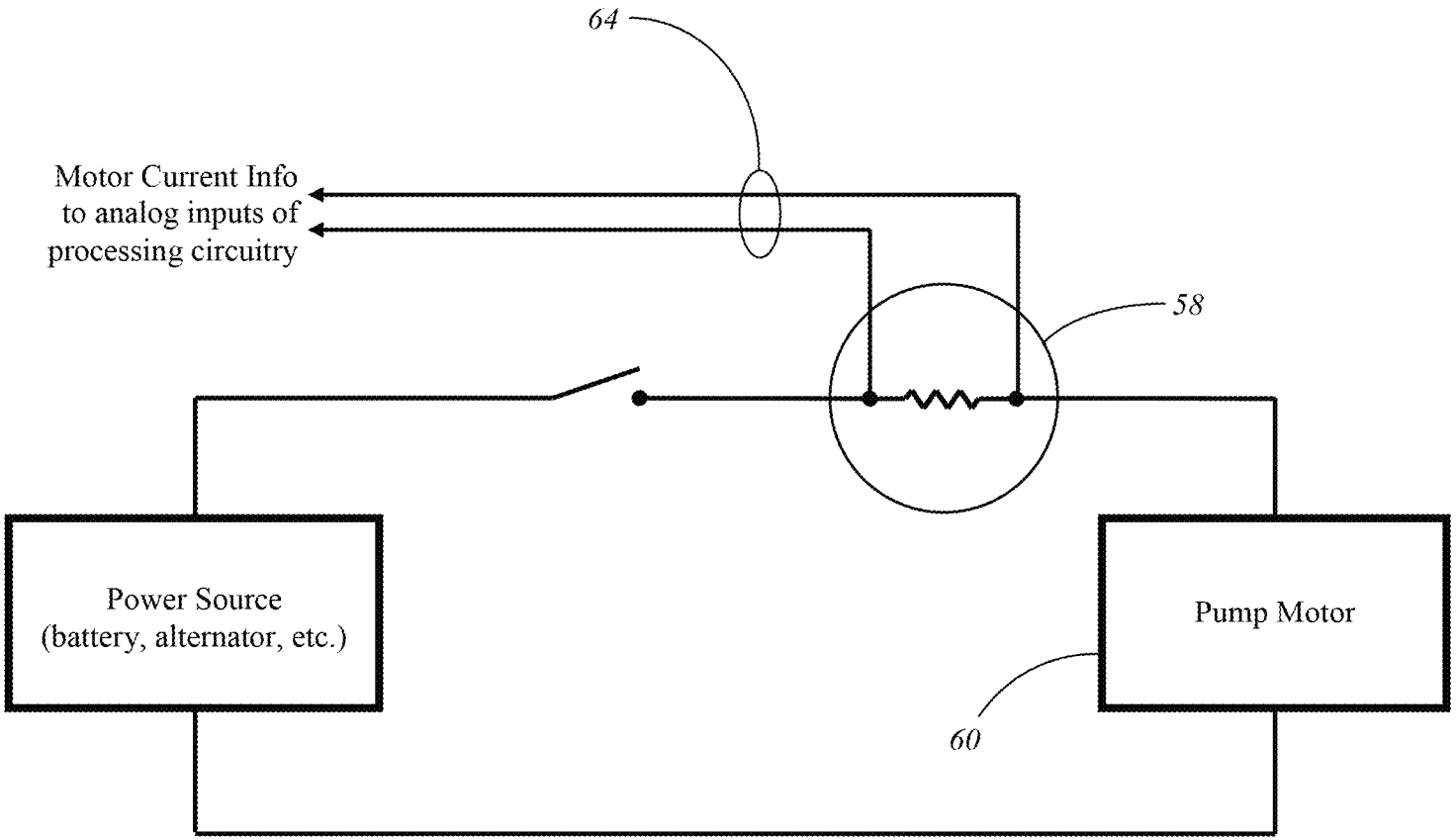
FIG. 16 is a block diagram of two analog inputs on a microcontroller being used to determine the current flowing through the electric motor of a pump, by measuring the voltage drop across a resistor in series with the electric motor.

Returning to the example using the microcontroller, one embodiment of the present disclosure can use two of the microcontroller analog inputs to measure the voltage on either side of the aforementioned series resistor. The voltage across the series resistor will vary in proportion with the motor current; the microcontroller can thus calculate the motor current based on the difference in the voltages measured on either side of the series resistor. A block diagram of this arrangement is shown in FIG. 16.

Figure 17:
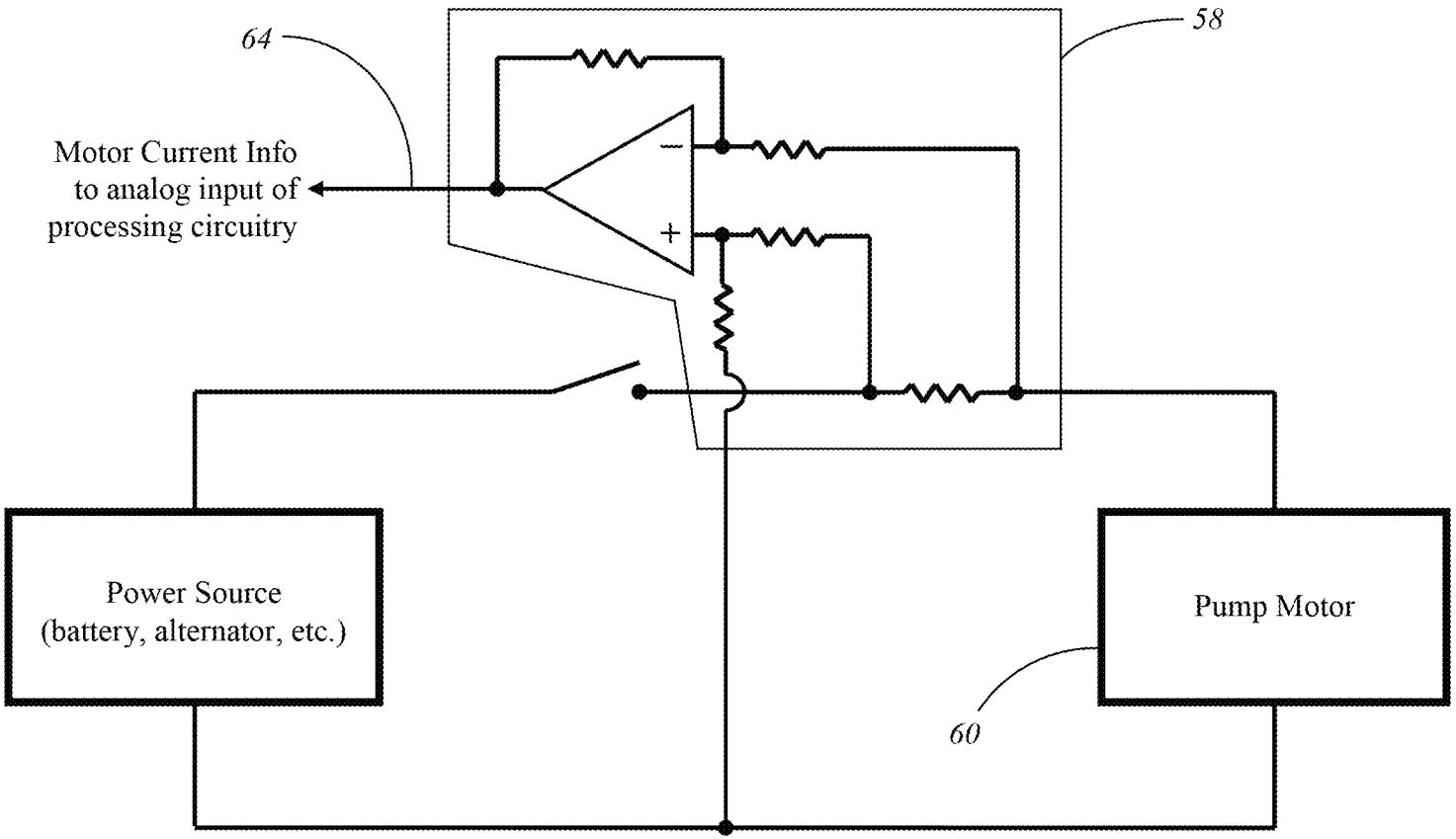
FIG. 17 is a block diagram of an analog input on a microcontroller being used to determine the current flowing through the electric motor of a pump, by measuring the output of a differential amplifier that is sensing the voltage drop across a resistor in series with the electric motor.

In another embodiment of the present disclosure, an operational amplifier can be configured in differential mode to directly measure the voltage across the series resistor. The operational amplifier could be, for example, an LM318 (Texas Instruments Inc., 12500 TI Boulevard, Dallas Tex. 75243, United States) or another device whose characteristics suit the specific application. The output voltage of the operational amplifier may then be monitored by a single analog input of the processing circuitry. One advantage of this embodiment is the reduction in the number of analog inputs required to realize this aspect of the present disclosure. Another advantage of this embodiment is the elimination of the need for the processing circuitry to perform the Ohm's Law calculations. A block diagram of this arrangement is shown in FIG. 17, for example.

Some embodiments of the present disclosure may use voltage, others may use current, and still others may use both depending upon the type of pump motor and the characteristics being monitored. In some embodiments, the processing circuitry may manipulate motor voltage info 66 and motor current info 64, for example by adjusting their offsets and dynamic range, to improve compatibility with system 154, described below.

Based upon the specific pumps, sensors, and other components chosen for the specific implementation, the present disclosure will have known and expected operational values for each pump in the ballast system. The detection of these values by the present disclosure provides real world feedback of what is actually happening. This stands in contrast to the open loop approach of time-based systems where the pump may continue to run without regard to what is actually occurring. The results can be as benign as wasting energy and draining batteries, to as severe as damaging pumps that are not intended to run "dry" or with occluded flow.

Pump runtime can still play an important role in the present disclosure. For example, the present disclosure can sense and record the normal amount of time required to fill a given ballast compartment. Armed with this data, if during the aforementioned fill operation the voltage sensor 62 or the current sensor 58 of FIG. 1 indicates that water flow has changed unexpectedly—for example, that water flow has reduced long before the ballast compartment should have been filled—the present disclosure can take appropriate action. Such action may include audible or visual notification of the wakeboat operator. In addition, the present disclosure may itself attempt to correct the unexpected situation. For the present example, unexpectedly reduced flow is often caused by an obstruction—a leaf, clump of weeds, or perhaps litter such as a plastic bag—sucked up against the intake for the ballast pump associated with pump motor 60. The present disclosure may attempt to resolve this via processing circuitry using control signal 68 to open circuit interrupter 56 for a short time to turn off pump motor 60, temporarily eliminating the suction and permitting the obstruction to drop away from the hull (or be swept away if the hull is moving through the water). If the pump in question can be operated in reverse, the present disclosure could also take advantage of that ability to forcefully "blow" the intake clear. After remedial actions have been taken, normal power can then be restored by processing circuitry and conditions monitored to confirm normal operation. Similar approaches may also prove useful in resolving problems such as air pockets or airlocks. Several attempts could be made to resolve the situation autonomously before alerting the wakeboat operator and requiring manual intervention.

A related advantage of embodiments of the present disclosure is its ability to detect and report failed pumps. Pumps have two primary failure modes: Open or shorted windings in the pump motor, and seized mechanisms due to bearing failure or debris jammed in the pump. Failed windings cause a circuit condition which the present disclosure can easily detect—if power is applied to a pump and there is anomalous current flow or voltage drop across the motor, the pump requires inspection. Similarly, seized pumps with intact windings do not begin rotation and do not develop CEMF, thus exhibiting a sustained high current condition easily detected by the present disclosure.

Another advantage of embodiments of the present disclosure is that pumps can be turned off when appropriate, thus preventing excessive useless runtime long after the associated ballast compartment has been filled or drained. Some pump styles, such as impeller pumps, have parts that wear based on their minutes of use with the wear becoming especially acute when the pump is run "dry" (i.e. after the ballast compartment is empty). The inconvenience and expense of maintaining such pumps can be substantially reduced by accurately and promptly depowering the pumps when their task is complete—something existing time-based ballast systems can only guess at, but which is an inherent capability of the present disclosure. And while other styles of pumps (centrifugal or so-called "aerator" pumps, for example) may not be as sensitive to run time, this capability of the present disclosure still pays dividends by preventing unnecessary power drain from onboard batteries.

Figure 2:
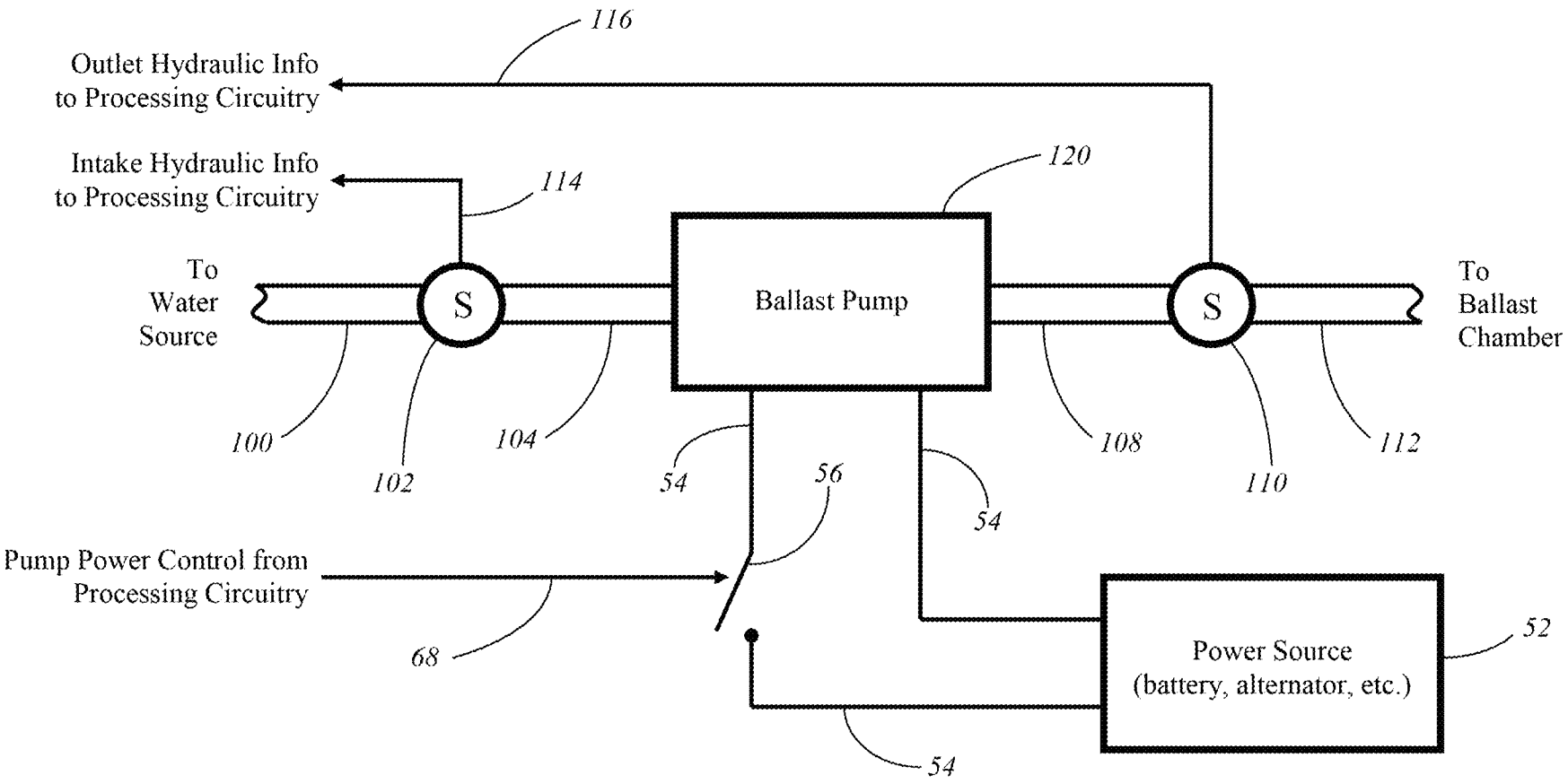
FIG. 2 is a block diagram of a wakeboat ballast control system with connections to associated components.

If monitoring the pump motor voltage or current is inconvenient, similar data may be obtained by measuring hydraulic characteristics at the intake and outlet of the pump. FIG. 2 illustrates an alternative approach to monitoring the operating condition of a pump. Water from the source flows through connection 100 and suitably connects to a hydraulic sensor 102. From sensor 102, the water then flows through connection 104 to ballast pump 120. From the outlet of pump 120 the water flows through connection 108, to a second hydraulic sensor 110, and thence through connection 112 to the ballast compartment. For clarity, FIG. 2 shows hydraulic sensors at both the intake and an outlet of the pump; however, a single hydraulic sensor at the intake or outlet can suffice in many embodiments.

Sensors 102 and 110 in FIG. 2 may measure pressure, flow, or any other suitable characteristic of the water before or after pump 120. The choice of sensor and its location will be dictated by the specifics of each application.

FIG. 2 thus illustrates the ability to monitor the intake and/or outlet conditions of pump 120 via sensors 102 and 110. As operating conditions of pump 120 change, the information conveyed via signals 114 and 116 will change as well. For example, if pump 120 is a Fill Pump (FP) and the ballast compartment fills to capacity, the aforementioned increased backpressure will cause an increase in the outlet pressure, and a decrease of outlet flow, at the outlet of pump 120. Sensor 110 will make that information available via signal 116. Other environmental changes which would have had an effect on the CEMF, and thus the pump motor voltage or current, will have effects on the pump intake and outlet characteristics and be detectable by sensors 102 and 110 of FIG. 2. This information can then be used by processing circuitry to manage the application of power from power source 52 to pump 120, via control signal 68 and circuit interrupter 56.

FIGS. 1 and 2 thus illustrate how the present disclosure can monitor the conditions of a pump in a ballast system. By replicating this approach for some or all pumps, an entire ballast system can be managed by the present disclosure and its unique advantages can be realized for pumps and components throughout the system.

Figure 3:
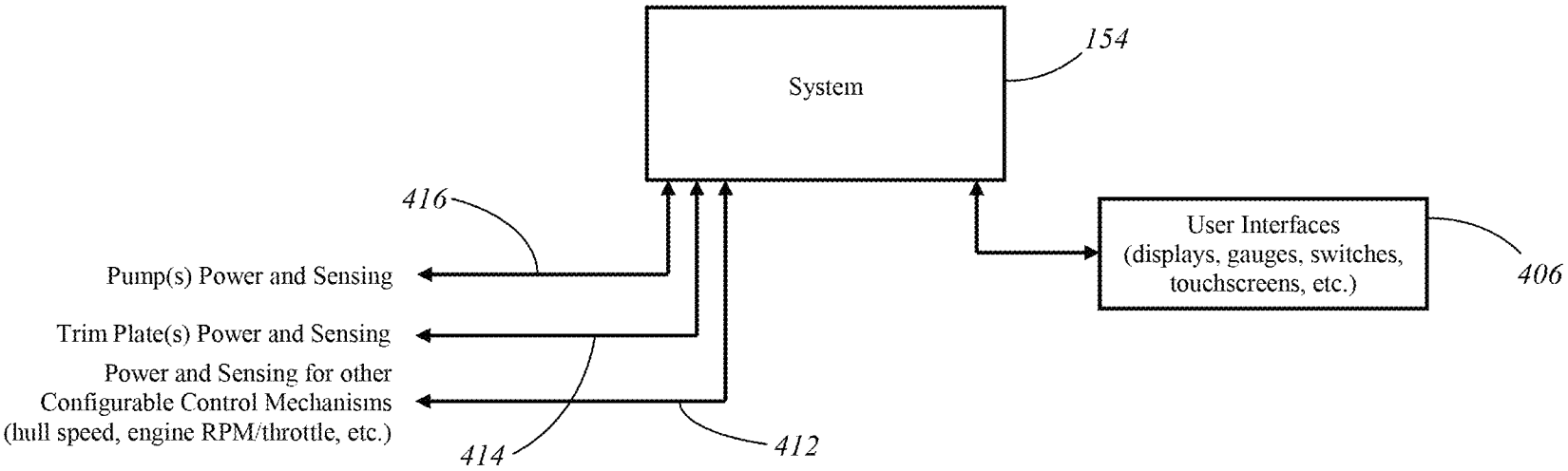
FIG. 3 is a block diagram of a wakeboat ballast control system with connections to associated components.

FIG. 3 illustrates one embodiment of the present disclosure wherein the pump monitoring advantages of FIGS. 1 and 2 are incorporated into a complete ballast control system. System 154 of FIG. 3 incorporates some of these control elements. In one embodiment, system 154 may include processing circuitry including microprocessors (such as the PIC18F25K80 microcontroller example mentioned above), logic, memories, programmable gate arrays or other field-configurable devices, and other digital electronic components. Such processing circuitry may also include analog circuitry including amplifiers, filters, digital-to-analog and analog-to-digital converters, and related components. System 154 may include electromechanical devices such as relays or their solid-state equivalents, switches, potentiometers, and similar components. System 154 may further include power supply and conditioning components and connectors for various cables and memory devices.

Analog or digital inputs may be configured with the processing circuitry of system 154 to allow various parameters to be monitored. As noted previously, analog inputs could be used to monitor voltage sensor 62 or current sensor 58 which provide information regarding the operational condition of the associated ballast pump and ballast compartments associated with the ballast pump. The processing circuitry of system 154 could also provide analog or digital outputs to operate controls, indicators, or other configurable devices. As just one example, such an output could be used to control circuit interrupter 56 of FIG. 2.

System 154 may interact with some or all of the various components, if present, on the wakeboat in question, including pump power and sensing via connection 416, trim plate power and sensing via connection 414, and power and sensing for other configurable control mechanisms such as boat speed and engine throttle/RPM 412. System 154 can also interact with user interfaces such as displays, gauges, switches, and touchscreens 406.

FIG. 3 depicts an embodiment of the present disclosure relating to pump monitoring, pump control, error sensing, operator notification and interaction, and the like. FIG. 3 represents a fully operational ballast control system that is a significant improvement over the existing art.

Figure 4:
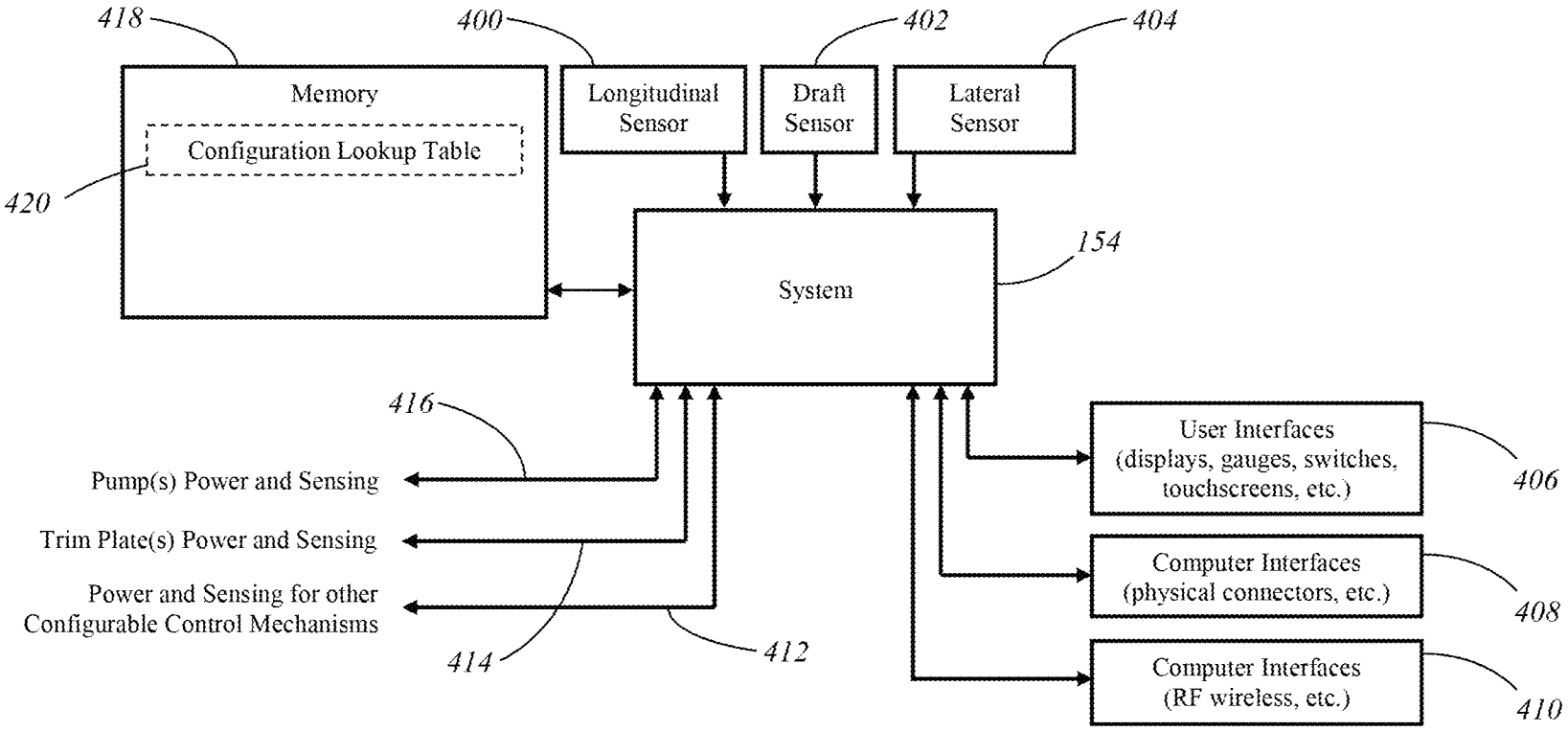
FIG. 4 is a block diagram of a wakeboat ballast control system with a configuration lookup table and connections to associated components.

FIG. 4 illustrates another embodiment of the present disclosure relating to hull control. System 154 is still present, together with its connections to pump power and sensing 416, trim plate power and sensing 414, power and sensing for other configurable control mechanisms such as boat speed and engine throttle/RPM 412, and user interfaces such as displays, gauges, switches, and touchscreens 406.

FIG. 4 also depicts sensors that measure the orientation of the wakeboat hull. In one embodiment, the sensor type can be an inclinometer (the word "clinometer" is sometimes used and is considered equivalent herein). An inclinometer is a device which measures rotation around an axis. The output of an inclinometer can be visual (as in a handheld device for direct human use), mechanical, electrical, or any other communication methodology appropriate for the specific application. Recent advancements in integrated circuit fabrication techniques, particularly microelectronic machining (or MEMS), have resulted in the availability of inclinometers packaged in a single component which can be incorporated into electronic devices. The inclinometer could be, for example, an ADIS16203 (Analog Devices Inc, One Technology Way, Norwood Mass., 02062, United States) or another whose characteristics suit the specific application.

Continuing with FIG. 4, one embodiment of the present disclosure incorporates a single sensor 400 to measure an orientation of the hull—in this specific example, its rotation around its longitudinal axis. Sensor 400 monitors the longitudinal angle of the hull and provides this information to system 154. System 154 and its processing circuitry thus receive measurements from the first sensor, and can monitor the longitudinal angle of the hull. Furthermore, since system 154 and its processing circuitry is coupled to ballast pumps via connection 416 and trim plates via connection 414, system 154 can also optionally operate the ballast pumps and trim plates. System 154 and its processing circuitry can be configured to make changes to trim plate parameters and the amounts of ballast in ballast compartments to seek and maintain a desired longitudinal angle of the hull.

Unlike existing ballast systems, this single-sensor embodiment of the present disclosure is not limited to managing the wakeboat ballast system based on amounts of water in various ballast compartments. Instead, with a single longitudinal sensor this embodiment of the present disclosure can manage the ballast system (and other parameters if present) to achieve a desired longitudinal hull angle.

Furthermore, this embodiment of the present disclosure can record, recall, and restore desired longitudinal hull angles. When a desirable wake configuration is achieved, system 154 of FIG. 4 can accept a command from user interface 406 to record its current configuration in a configuration lookup table 420 residing in a memory 418. While parameters such as trim plate settings and ballast amounts in various ballast compartments may be recorded, this embodiment of the present disclosure can also record the longitudinal angle of the boat. Multiple such configuration entries may be stored by system 154 in memory 418, optionally associated with mnemonically convenient labels such as the names of participants, the type of wake thus produced, notable characteristics such as time and date, and other information.

Once stored in memory 418, such configurations may be recalled by system 154 in response to commands from user interface 406. System 154 can then restore the various parameters to return the wakeboat to the same condition as the selected configuration. As noted above, however, the stored parameters may not yield the exact same configuration due to changes in weight distribution and other factors. Therefore, when restoring and maintaining a selected configuration, system 154 can monitor sensor 400 for differences in the longitudinal angle of the boat and make adjustments to those parameters over which it has control to accommodate changes.

For example, a 200 pound passenger moving from one side of the passenger compartment to the other would cause a change in the longitudinal angle. System 154 of FIG. 4 would become aware of that change via data from longitudinal sensor 400 and could automatically restore the desired longitudinal angle by controlling the ballast pumps as described.

Likewise, an exchange of watersport participant—and the resulting weight shift if the participants are of differing weights—could be accommodated autonomously. Indeed, the present disclosure can accommodate changes regardless of their cause, intentional or not, and do so entirely automatically.

If desired, system 154 of FIG. 4 could notify the wakeboat operator via user interface 406 when conditions have changed or when system 154 believes adjustments to accommodate such changes are required. Optionally, system 154 could wait for operator confirmation before proceeding with such adjustments, or wait a configurable amount of time before automatically proceeding with the changes in the absence of overt confirmation.

It should be noted that a multitude of factors may cause transient changes to monitored parameters such as the longitudinal angle of the boat. Gusts of wind, waves at odd angles, momentary passenger relocations, and similar temporary events may cause changes that need not be immediately accommodated. Indeed, in highly dynamic environments the information provided by the present disclosure's sensors may require a variety of filtering techniques to eliminate extraneous content. For example, if the body of water in which the boat floats is not calm, the longitudinal sensor 400 of FIG. 4 may indicate repeated minor fluctuations in longitudinal angle that need not—indeed should not—be accommodated. To address this specific example, system 154 might incorporate a low pass filter, apply an averaging algorithm, or otherwise modify the information received from longitudinal sensor 400 to retain just the necessary content. A broad spectrum of filtering techniques for a wide range of possible conditions may be supported by the present disclosure and be realized programmatically, electrically, mechanically, or by any approach as suited to the specifics of the embodiment in question.

Continuing with FIG. 4, another embodiment of the present disclosure adds a second sensor 404 to measure the angle of the boat around a second axis—in this specific example, its lateral axis. Sensor 404 monitors the lateral angle of the boat and provides this information to system 154. In combination with the aforementioned longitudinal sensor 400, this two-sensor embodiment of the present disclosure enables system 154 to record, recall, and restore desired hull angles for both axes that affect wake performance. All of the features and capabilities of the single-sensor embodiment described above are retained and enhanced by the addition of lateral sensor 404. System 154 is thus enhanced with the ability to record, recall, and restore conditions relating to the lateral angle in addition to those relating to the longitudinal angle, and use that information to control the ballast pumps as described earlier for the single sensor embodiments.

In one embodiment, the second sensor could be a second inclinometer used in the example above. In another embodiment, the two inclinometers could be integrated into a single device to reduce parts count and simplify processing circuitry design and construction. Such a dual axis inclinometer could be, for example, an ADIS16209 (Analog Devices Inc, One Technology Way, Norwood Mass., 02062, United States) or another whose characteristics suit the specific application.

The longitudinal and lateral axes are illustrated in the present embodiments for convenience of illustration and explanation. Other axes besides the longitudinal and lateral axes may be used in different embodiments of the present disclosure. Other sensor types may also be advantageously used; for example, system 154 could derive hull rotation from the measurements of typical marine draft sensors, correlating changes in hull tilt to changes in draft depth as the waterline changes at various locations on the hull. Multiple quantities, arrangement, and alignment of sensors may be used to achieve the advantages of the present disclosure.

A further embodiment of the present disclosure adds a draft sensor 402 to measure the depth of the hull below the water surface. Sensor 402 does not measure the depth of the water, but the draft—the depth of the boat hull in the water. As noted previously, it is possible to achieve the same longitudinal and lateral hull angles while the hull sits at different depths in the water. A lightly loaded hull will displace less water and float shallower, while a more heavily loaded hull will displace more water and float deeper, and yet both conditions may be achieved with identical longitudinal and lateral angles. The amount of water displaced by the hull is an important factor in wake development behind the boat, and in the most advantageous embodiment of the present disclosure, draft sensor 402 enables this third degree of freedom to be included in system 154's control of the ballast pumps, and thus its management of the wakeboat ballast control system.

An example will help in understanding the advantage and importance of draft sensor 402. Presume that the earlier two-inclinometer embodiment of the present disclosure recorded a desired configuration when the boat was lightly loaded. At some later time, that configuration is recalled and system 154 of FIG. 4 is instructed to restore that configuration—except that at this later time more passengers are on board and the boat is thus more heavily loaded. System 154 may indeed restore the desired longitudinal and lateral hull angles, but lacking knowledge of the increased weight the result may be that the hull floats much higher or much lower in the water. A different draft means different displacement, which means the resulting wake may be substantially different from what was last produced with the recalled configuration, despite identical longitudinal and lateral hull angles.

Some two-inclinometer embodiments of the present disclosure may offer manual adjustment of draft. If the wakeboat operator notices that the hull is floating higher or lower than desired, user interface 406 of FIG. 4 could be used to instruct system 154 to adjust ballast amounts up or down while maintaining the target longitudinal and lateral hull angles. In this manner, the human operator is closing the loop with respect to draft in the absence of draft sensor 402.

An embodiment of the present disclosure could be produced using a single inclinometer to monitor a single axis, and in many cases this will be sufficient as it represents an enormous improvement over the existing art. Another embodiment of the present disclosure could be produced with two inclinometers to monitor both the longitudinal and lateral axes. A further improvement would include both inclinometers and the draft sensor to monitor all three degrees of freedom that affect how the hull interfaces with the surrounding body of water.

Inclinometers are not the only way to measure how the hull interacts with the surrounding water. Another embodiment of the present disclosure uses multiple draft sensors mounted at different locations on the hull. For a given axis of rotation, the placement of a draft sensor away from the axis in question yields differing draft measurements that correlate to different amounts of hull tilt around that axis. An embodiment of the present disclosure that deploys two draft sensors can thus derive tilt information for two axes. An advantage of this embodiment is that the separate measurements from these same draft sensors can themselves be correlated to yield an overall hull draft measurement without requiring a third sensor.

Some embodiments of the present disclosure may permit a single or dual sensor installation to be later upgraded by the installation of additional sensors. This would permit an entry-level embodiment of the present disclosure to be initially affordable to a greater number of wakeboat purchasers, and allow them to upgrade as their circumstances permit. This concept could be expanded to allow the present disclosure to be deployed on wakeboats having only rudimentary hull control implements; for example, at first a boat may have only trim plates and no formal ballast system. Despite the lack of a ballast system, a wakeboat having only trim plates nevertheless does have some limited ability to modulate its hull behavior and the present disclosure could take best advantage of whatever capabilities currently exist on the boat in question. Another example would be the addition of trim plates to a wakeboat initially lacking them, or the enlargement of ballast compartments from factory stock to a custom version. When hull control implements are added or changed, the present disclosure could be connected to them and then deliver improved performance.

Some embodiments of the present disclosure include interfaces to external devices. For example, FIG. 4 illustrates computer interfaces 408 which may include physical connectors or other apparatus to permit Personal Digital Assistants (PDA's), USB memory sticks ("thumbdrives"), smartphones, portable music players, handhelds, tablets, laptops, notebooks, netbooks, and other portable computing devices, and similar electronic products to communicate with system 154 or memory 418. Radio Frequency (RF, or wireless) computer interfaces 410 may also be included to permit compatible devices to communicate with system 154 or memory 418 without requiring a wired connection.

One embodiment of the present disclosure can use a portable computer such as a smartphone, tablet computer, laptop computer, or similar device to realize some of its processing circuitry. Such a computing device could be, for example, an Apple iPad (Apple Incorporated, 1 Infinite Loop, Cupertino, Calif. 95014, United States) or another device whose characteristics suit the specific application. Referring to FIG. 4, the iPad includes many of the components used by the present disclosure including system 154, memory 418, user interfaces 406, computer interfaces 408 and 410, and sensors 400 and 404. Those components of the present embodiment not included in the iPad or similar computing device such as sensor 402, and power and sensing 412, 414, and 416, could be connected to the computing device using computer interfaces 408 and/or 410 to realize the embodiment of the present disclosure depicted in FIG. 4.

The social nature of watersports often sees participants going out on different watercraft on the same or different days. A great deal of time can be spent fine tuning and then storing the wake preferences of a given participant in that watercraft's ballast system, but all of that effort must be repeated when that participant goes out on a different watercraft—even if the watercrafts are identical makes and models. This problem compounds with the number of participants and the number of watercraft between them, wasting a considerable amount of valuable time and expensive fuel as the same actions are repeated over and over by every participant on every watercraft.

One embodiment of the present disclosure corrects this problem via portable device interfaces 408 and RF (or wireless) computer interfaces 410. Watersports participants could, for example, copy selected contents of memory 418 to an external device. When they return to the same or another wakeboat with their external device, their preferred configurations could be copied to memory 418 on that wakeboat and made available for use. Thus wakeboats equipped with the present disclosure need not store permanent copies of their configurations, and changes to a participant's preferences could automatically "follow" them from boat to boat.

RF (or wireless) interfaces 410 could also be used for direct wakeboat-to-wakeboat data transfer. For example, if the operator of one wakeboat stores a particularly advantageous configuration, it could be shared with other wakeboats in the immediate vicinity via an RF connection through interface 410. In this manner, human error associated with the manual duplication of data could be substantially reduced. Participant preferences could also be copied via RF connection in like fashion when passengers move from one wakeboat to another, eliminating the requirement to carry external devices from boat to boat.

Connection to external devices via computer interfaces 408 or 410 could also be used to update the software or other operating parameters of system 154 or other components and devices within the overall system.

Another inadequacy of the existing art is inaccurate reporting of onboard resources such as fuel. For example, it is almost a standing joke amongst watercraft owners that their fuel gauges bear only the most remote relationship to the amount of fuel actually in the fuel tank. This condition has only worsened as analog gauges have been replaced by touchscreens and other computerized displays with their suggestion of single-digit accuracy. More than a source of humor, however, this situation can be dangerous if the watercraft operator relies upon such invalid data and is thus misinformed as to the actual amount of fuel onboard. This inaccuracy is often exacerbated by irregularly shaped tanks, offcenter tank sensors, and nonlinear response from tank sensors.

The result is that the tank fill level reported to the wakeboat operator may not correspond to the actual fill level in the tank itself. For example, when the tank fill level is shown as 50%, it may actually be significantly more or less than the indicated value. Worse, the magnitude and direction of the error may change throughout the indicated range—making it nearly impossible for the watercraft operator to mentally correct from the indicated reading.

Yet another limitation of the existing art is that ballast configurations are unique to that watercraft manufacturer and model. Even if participants remember the "settings" that produce their preferred wake in one watercraft, those values are unlikely to apply to other watercraft. Existing embodiments provide no method to relate one watercraft model's set of preferred parameters to another watercraft model, again wasting a considerable amount of time and fuel for each and every watercraft model for each and every participant.

Figure 5:
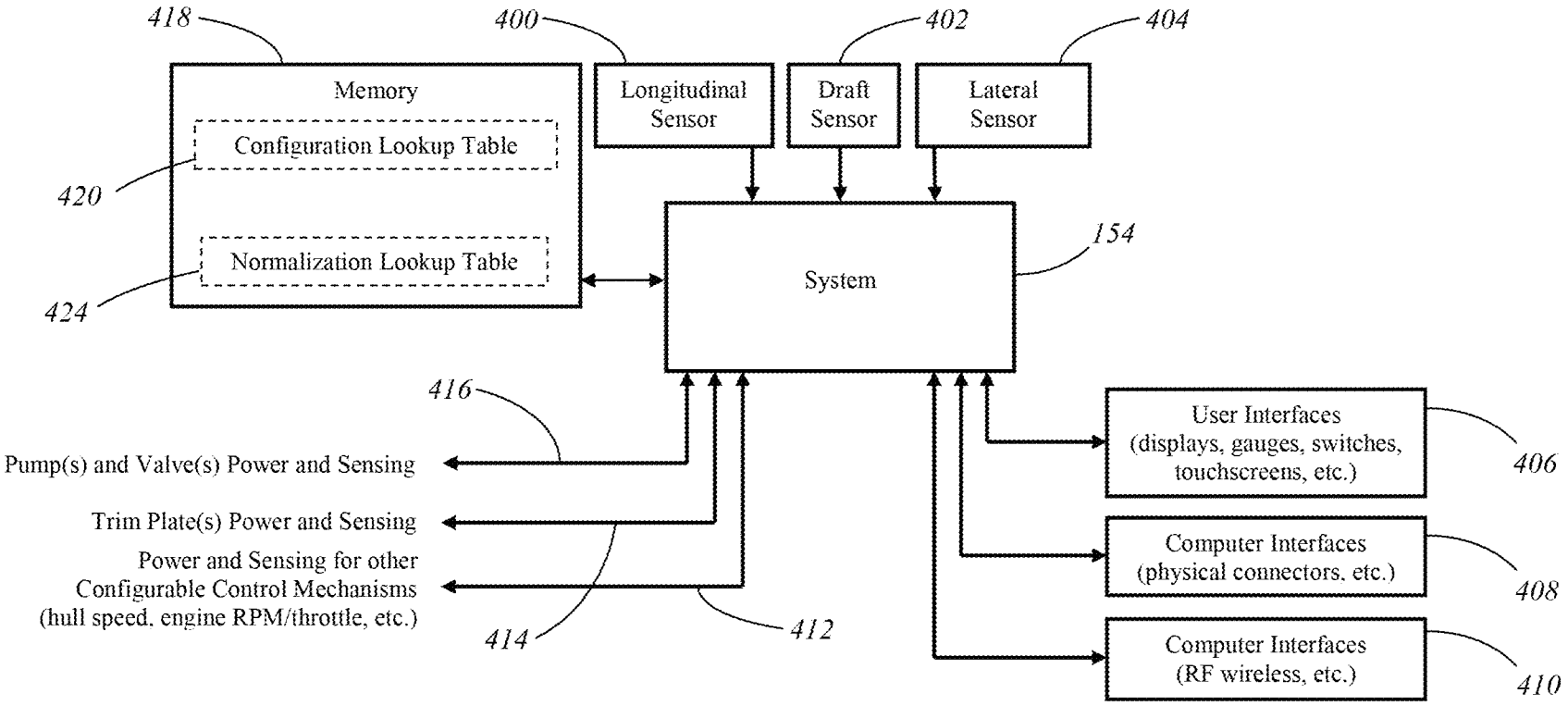
FIG. 5 is a block diagram of a wakeboat ballast control system with a configuration lookup table, a normalization lookup table, and connections to associated components.

One embodiment of the present disclosure addresses this shortcoming of the existing art by normalizing a wakeboat's characteristics to a common set of parameters. Similar to industry standards that otherwise competitive manufacturers adopt for their mutual benefit, this normalized parameter set enables the ballast and wake behavior of a given watercraft to be described in terms that can be related to other watercraft equipped with the same capability. FIG. 5 illustrates one embodiment of the present disclosure that incorporates this improvement. Based on FIG. 4, FIG. 5 adds a database comprising a normalization lookup table 424 to memory 418 which already comprises configuration lookup table 420. Sensors 400, 402, and 404 are also still present, as are system 154 and its processing circuitry, together with other components (and the associated capabilities that derive from them) in previously described embodiments of the present disclosure.

Figure 13:
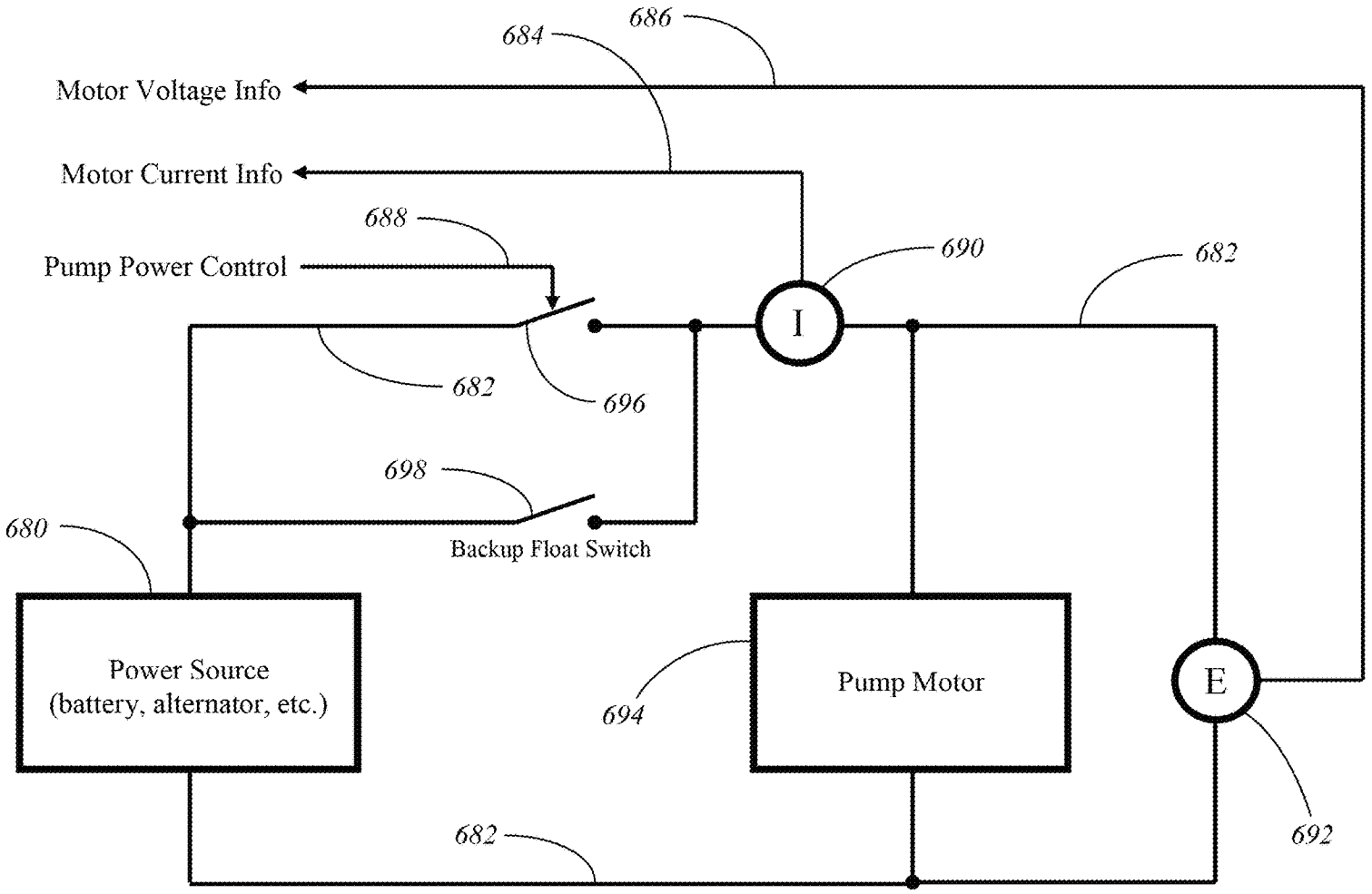
FIG. 13 is a block diagram of a pump configured with voltage and current measurement, a power source, circuit interrupters, a backup float switch, and associated electrical interconnections.

In one embodiment, configuration lookup table 420 of FIG. 13 stores values specific to the watercraft in which it is installed. Normalization lookup table 424 can then be used to correlate the orientation of the hull of the first watercraft to a standardized set of parameters. Those normalized, generic parameters can then be transferred to other watercraft via portable device interfaces 408 or RF (wireless) interfaces 410. Upon their arrival at a second watercraft, that second watercraft's normalization table 424 can be used to correlate the normalized parameters into values applicable to the second watercraft, which can then be stored in the second watercraft's configuration lookup table 420. These values then become available to the processing circuitry for control of the ballast system as already described.

During a transfer of configuration data, one embodiment of the present disclosure can transmit or exchange manufacturer, model, and other useful characteristics between the watercrafts involved. System 154 of FIG. 5 on one or both of the watercraft can then examine this information and make decisions regarding the normalization process. For example, if the manufacturers and models are identical, normalization may not be required and the normalization step on both watercraft could be omitted. In another case, where the manufacturers are identical but the models are dissimilar, system 154 may have sufficient information regarding model similarities to decide which of normalized values or unmodified data from configuration lookup table 420 would be more advantageous. Many such enhancements may be realized by an increase in the types and amount of identifying information shared between watercraft.

Another limitation of the existing art is that specialized hull shapes often encourage the accumulation of water in the lowest areas of the hull, often referred to as the "bilge". While virtually all watercraft are equipped with bilge pumps to drain undesired water, the specialized hull shapes used with watersport boats often cause such water to accumulate in thin layers covering a large surface area. This results in a large amount of water whose level is not deep enough for traditional bilge pumps to evacuate it.

For example, in contrast to the V shaped hulls of many boats, the interior hull surfaces of some sport watercraft have large flat regions where water can pool. These flat areas can be many square feet in surface area, which means that even a thin layer of water can amount to many gallons of water.

Other examples include more traditional V shaped hulls, but where the keel of the hull runs almost horizontal along the longitudinal axis for distances of many feet. Again, a shallow depth of water extending a lengthy distance can add up to a surprisingly large volume of water, yet its very shallowness prevents traditional bilge pumps from evacuating it.

Traditional bilge pumps fail to handle shallow water depths primarily because of their intake design. To pump water, their intakes must be completely submerged so as to maintain "suction" and draw water instead of air. If any portion of the intake is above water, suction is lost and little to no water is pumped.

Another limitation of traditional bilge pumps is that they are typically controlled by a water detecting switch, the most common variety being a "float switch". As the name implies, a buoyant component or "float" is coupled to an electrical switch such that when the water level rises above a certain point, the switch is closed and power is applied to the bilge pump. When the water level drops sufficiently, the float drops as well; the electrical switch is thus opened and bilge pump power is removed.

Float switches, and other types of bilge pump switches, suffer from conflicting design parameters. If they trigger upon too high a water level, too much water can be allowed to accumulate before the bilge pump is activated. If they are set too low, they can be excessively triggered by small amounts of water sloshing back and forth due to natural hull motion. In this latter case, the bilge pump can be excessively cycled, often when the actual water level is below that necessary for the bilge pump to do useful work. Such treatment consumes the useful lifespan of the bilge pump and also wastes energy.

The inadequate design of existing bilge pumps and their switches can thus permit large amounts of water to remain within the hull where it encourages mold, mildew, corrosion, deterioration of equipment, and other moisture related problems. An improvement to bilge pump and switch design would be of significant benefit, particularly to the sport watercraft industry with its specialized hull shapes that seem almost designed to accumulate water that is difficult to effectively evacuate.

Figure 6:
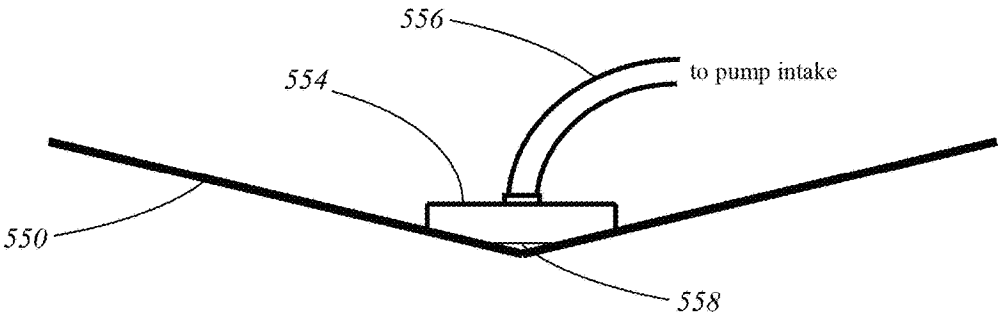
FIG. 6 illustrates a first one of three configurations of pump adapters.

FIG. 6 illustrates one embodiment of the present disclosure. Adapter 554 is mounted to the inside surface of V shaped hull 550. One end of hose 556 connects to adapter 554; the other end of hose 556 connects to the intake of the (remotely located) bilge pump.

Continuing with FIG. 6, the bottom of adapter 554 is shaped to fit closely with the inside profile of hull 550. However, the bottom center of adapter 554 is flat and does not match the angle of hull 550. This results in a small channel 558 of generally triangular cross section running under adapter 554. Channel 558 runs entirely across adapter 554 and is open at both ends to the surrounding area.

Figure 7:
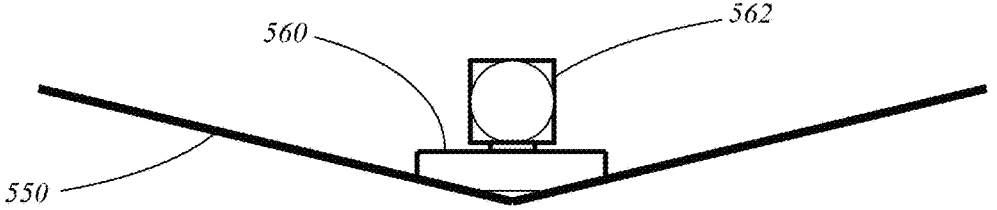
FIG. 7 illustrates a second one of three configurations of pump adapters.

FIG. 7 illustrates another embodiment of the present disclosure. In this embodiment, adapter 560 again mounts to hull 550 with a small channel running underneath. However, in FIG. 7 the bilge pump 562 mounts directly to adapter 560. This arrangement may be advantageous in certain installations over having a remotely mounted bilge pump with connecting hose. Other than the direct versus remote mounting of the bilge pump, however, the embodiments in FIGS. 6 and 7 are functionally equivalent and only one style will be further illustrated.

Figure 9:
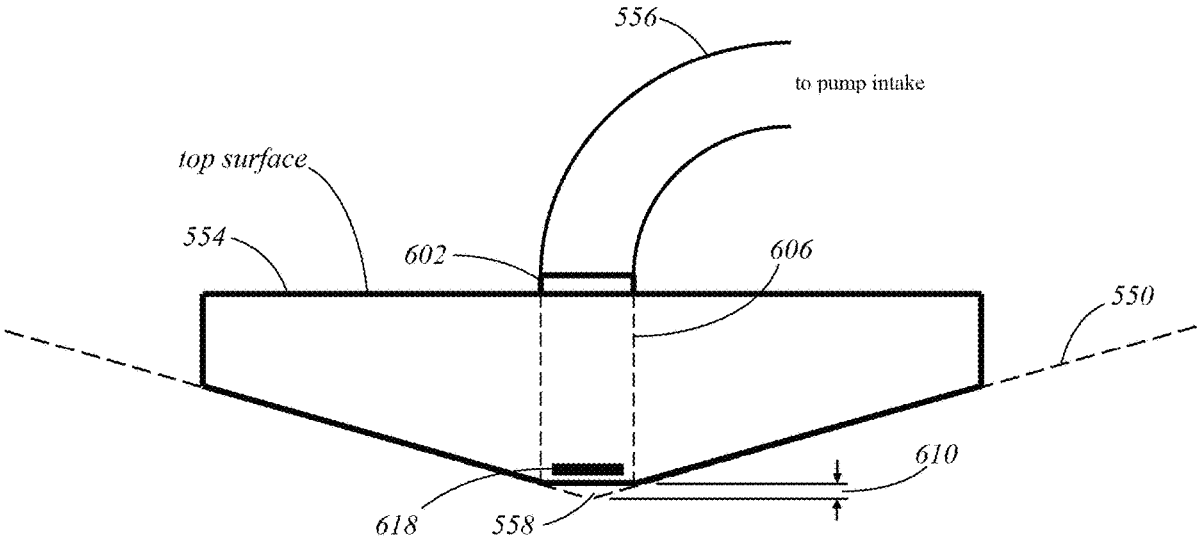
FIG. 9 is a closeup side view of one configuration of a pump adapter for bilges having a V profile.

FIG. 9 provides a closeup side view of the V hull version of the present disclosure. Adapter 554 is profiled to match the angle of hull 550. Hose 556 attaches to adapter 554 at connection 602, which may be a threaded connection or any other type appropriate for the application and hose type in use. Connection 602 is fluidly connected to a passageway 606 which passes vertically through adapter 554 and provides hydraulic communication from connector 602 to the flat bottom surface of adapter 554, and thus to channel 558 formed by adapter 554 and hull 550.

Continuing with FIG. 9, water which accumulates in the area surrounding adapter 554 will flow through channel 558. Dissimilar water levels on either side of adapter 16*a* will self-level via channel 558. Channel 558 thus provides a passage for fluid along the bottom surface of the adapter. As noted above, channel 558 is also in hydraulic communication with passageway 606, thus with hose 556, and thus the bilge pump.

Still referring to FIG. 9, distance 610 is the height of channel 558. Due to the uninterrupted hydraulic communication from channel 558 to the bilge pump, channel 558 becomes the intake of the bilge pump and distance 610 becomes the minimum depth to which water can be evacuated without the bilge pump beginning to draw air. Distance 610 can be easily set to any desired water depth as long as channel 558 has adequate cross sectional area to permit sufficient water flow to the bilge pump. In practice, distance 610 can be made quite low, permitting the bilge pump to evacuate the water level much lower than traditional bilge pumps.

Figure 10:
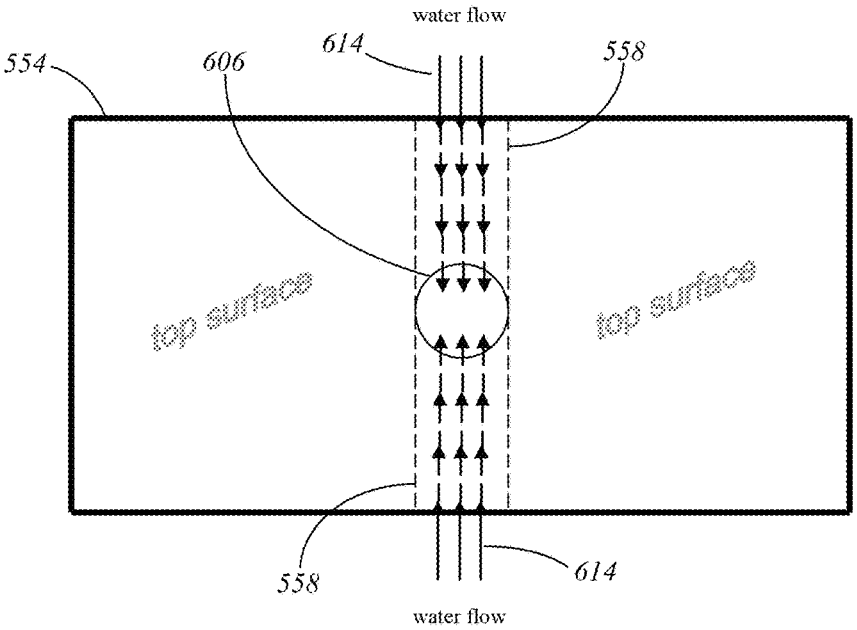
FIG. 10 is a closeup top view of one configuration of a pump adapter for bilges having a V profile.

FIG. 10 provides a top view of adapter 554. Channel 558 is shown to pass completely beneath adapter 554, with water 614 flowing in from both directions toward vertical passageway 606.

Adapter 554 may optionally include one or more water sensors. In one embodiment, a water sensor 618 is located symmetrically on either side of adapter 554 immediately above channel 558. In this embodiment, automated bilge pump operation occurs when both water sensors 618 detect water; this ensures that both openings of channel 558 are underwater, thus preventing the bilge pump from futilely attempting to pump water when its intake is exposed to open air.

Figure 8:
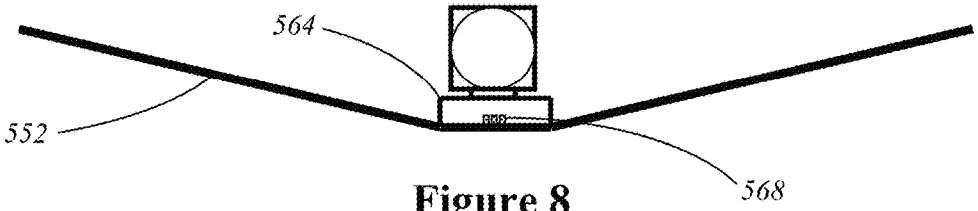
FIG. 8 illustrates a third one of three configurations of pump adapters.

FIG. 8 illustrates another embodiment of the present disclosure, for a flat bottomed hull or a hull with a flat section. Adapter 564 is attached to the flat portion of hull 552. The bottom center of adapter 564 has one or more slots 568 that run entirely across adapter 564 and functionally correspond to the channel 558 in FIGS. 6 and 7.

Figure 11:
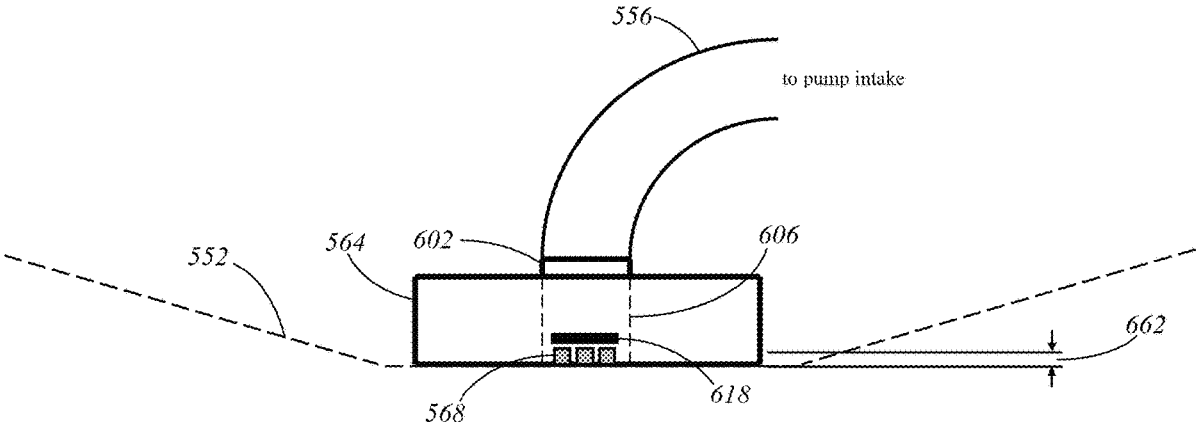
FIG. 11 is a closeup side view of one configuration of a pump adapter for bilges having a flat profile.

FIG. 11 provides a closeup side view of the flat hull version of the present disclosure. Adapter 564 is profiled to match the angle of hull 552. As with the V hull embodiment, hose 556 attaches at connection 602, which may be a threaded connection or any other type appropriate for the application and hose type in use. Connection 602 is fluidly connected to a passageway 606 which passes vertically through adapter 564 and provides hydraulic communication from connector 602 to the flat bottom surface of adapter 564, and thus to slots 568.

Continuing with FIG. 11, water which accumulates in the area surrounding adapter 564 will flow through slots 568. Dissimilar water levels on either side of adapter 564 will self-level via slots 568. As noted above, slots 568 are in hydraulic communication with passageway 606, and thus hose 556, and thus the bilge pump.

Still referring to FIG. 11, distance 662 is the height of slots 568. Due to the uninterrupted hydraulic communication from slots 568 to the bilge pump, slots 568 become the intake of the bilge pump and distance 662 becomes the minimum depth to which water can be evacuated without the bilge pump beginning to draw air. Distance 662 can be easily set to any desired water depth by appropriately sizing slots 568 as long as slots 568 have adequate cross sectional area to permit sufficient water flow to the bilge pump. In practice, distance 662 can be made quite low, permitting the bilge pump to evacuate the water level much lower than traditional bilge pumps.

Figure 12:
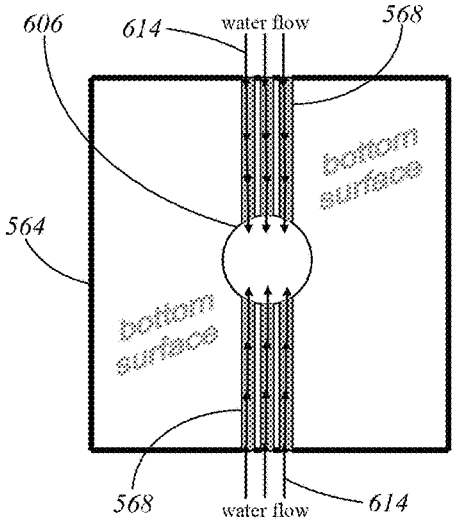
FIG. 12 is a closeup bottom view of one configuration of a pump adapter for bilges having a flat profile.

FIG. 12 provides a top view of adapter 564. Slots 568 are shown to pass completely beneath adapter 564, with water 614 flowing in from both directions toward vertical passageway 606.

Adapter 564 may optionally include one or more water sensors. In one embodiment, one water sensor 618 is located symmetrically on either side of adapter 564 immediately above slots 568 for a total of two water sensors. As with the V hull embodiment, automated bilge pump operation occurs when both water sensors 618 detect water; this ensures that both ends of slots 568 are underwater, thus preventing the bilge pump from futilely attempting to pump water when its intake is exposed to open air.

Adapters 554 and 564 of FIGS. 6 through 12 are not required to be of a particular shape, size, or material. Their primary requirements are to interface with the hull shape in question, and to hydraulically connect to the bilge pump either directly or through a hose or other suitable conduit. Thus the shape and size of the adapter, its constituent material(s), its manner of fabrication, and other fabrication details may be dictated by the specifics of the application. Variations might include but not be limited to locating the pump or hose connection on the side instead of the top, or shaping the adapter to fit into a specific location.

The advantages of the present disclosure are numerous. The complete lack of moving parts increases reliability, a very important attribute in marine applications. The adapter can be fabricated from a single shaped or molded piece of plastic, rendering it rust and corrosion proof even in salt water environments. One embodiment can be provided to permit on-the-spot resizing and reshaping to provide a custom fit to the hull in question. Another embodiment can be sold without hull beveling or slots whatsoever, permitting entirely custom adapters to be created with common shop tools by the final installer.

FIG. 13 illustrates one embodiment of bilge pump control and sensing in the present disclosure. Bilge pump 694 comprises an electric motor operatively coupled to a power source 680 such as a battery or alternator. Bilge pump motor 694 is part of a pump such as the Johnson Ultra Ballast Pump (Johnson Pump of America, Inc., 1625 Hunter Road, Suite B, Hanover Park Ill., 60133, United States), a centrifugal style pump such as the Rule 405FC (Xylem Flow Control, 1 Kondelin Road, Cape Ann Industrial Park, Gloucester Mass., 01930, United States), or another pump whose characteristics suit the specific application.

Power to ballast pump motor 694 is controlled by circuit interrupter 696, shown as a single device for clarity but which may be one or more of a manual switch, a relay or functionally similar device controlled by control signal 688, or other components suitable for making and breaking circuit 682 manually or under system control. When circuit interrupter 696 is closed and thus circuit 682 is completed through pump motor 694, the voltage from power source 680 will be applied to pump motor 694 and current will flow through circuit 682.

Backup float switch 698 of FIG. 13 is also supported in addition to the other circuit interrupter devices represented by 696. It is common practice in watercraft construction to include a fail-safe backup float switch that can apply power to bilge pump motor 694 if the bilge water level becomes excessive, without any reliance upon other switches or sensors or components or human intervention. The present disclosure is completely compatible with such emergency bilge switches if their installation is desired.

Continuing with FIG. 13, the conditions and operational condition of bilge pump motor 694 can be monitored by voltage sensor 692, current sensor 690, or both in the same manner as already thoroughly described earlier in this specification for ballast pump motors with respect to FIGS. 3, 15, 16, and 17. Motor voltage info 686, motor current info 684, or both are made available for analysis by processing circuitry, and processing circuitry can control power application to bilge pump motor 694 via pump power control 688 which controls one or more aspects of circuit interrupter 696.

Instrumenting the bilge pump in the manner shown in FIG. 13 yields substantial advantages to the present disclosure of both convenience and safety. For example, the ability to know the operational conditions of bilge pump motor 694 via motor voltage information 686 and motor current information 684 enables the present invention to reduce or eliminate its dependency upon traditional water sensors, which are often the least reliable component in the bilge pumping system. In one embodiment, bilge pump motor 694 could be periodically powered up and then its voltage and current monitored; if motor voltage information 686 or motor current information 684 indicates bilge pump motor 694 is pumping water, power could remain applied until motor voltage information 686 or motor current information 684 indicates that bilge pump motor 694 has evacuated the bilge water. Feedback from bilge pump motor 694 can be indicative of pumping conditions and the operational condition of the associated bilge compartment; if the water level is or becomes too low for the pump to draw water, bilge pump motor 694 will see a reduced workload just as described for a ballast drain pump with respect to FIG. 1 earlier in this specification. In this manner the bilge pump itself becomes the water sensor, allowing reliability to increase and costs to decline.

Another safety enhancement delivered by the present disclosure is the ability to detect certain failure conditions as described earlier in this specification with respect to FIG. 1 for ballast pumps. Loose hoses and failed fittings can occur with bilge pumping systems just as they can ballast systems, and the danger of such an event going undetected in a bilge pumping system can be even more serious. The aforementioned ability of the present disclosure to monitor the operational conditions of bilge pump motor 694 in FIG. 13 can permit the detection of the reduced backpressure resulting from a loose hose or failed fitting. When used in conjunction with one or more sensors such as water sensors 618 of FIGS. 9 and 11, the present disclosure can sense that water is present independently of the bilge pump and thus know that bilge pump motor 694 of FIG. 13 should see a load commensurate with the pumping of water through its normal backpressure. If water is present yet bilge pump motor 694 does not return appropriate motor voltage information 686 or motor current information 684, the watercraft operator can be notified via indicators 708 and/or 710 of FIG. 14, other bilge pumping systems can be activated, or other appropriate measures taken.

Yet another safety enhancement delivered by the present disclosure is its ability to detect and report failed bilge pumps. As previously described with respect to ballast pumps, electric bilge pumps have two primary failure modes: Open or shorted windings in the pump motor, and seized mechanisms due to bearing failure or debris jammed in the pump. And also as previously described with respect to ballast pumps, both of these conditions can be detected by the present invention via the bilge pump control and sensing advancements shown in FIG. 13—even if there is no water to be pumped out of the bilge. The improvement to boating safety delivered by this aspect of the present disclosure should not be overlooked. It is exceedingly dangerous to operate a watercraft if its bilge pump(s) have failed. The advancements of the present disclosure can inherently provide detection and notification of this exceptionally serious condition as soon as power is first applied—before the watercraft even leaves the dock—and optionally test on a periodic basis while the watercraft is in use. In this manner the present disclosure can substantially improve the safety of watercraft and passengers alike.

As noted earlier in this specification with respect to with ballast pumps, a key advantage of the present disclosure is its ability to be used with standard off-the-shelf bilge pumps. It is not necessary to use customized pumps or pumps with integrated sensors to achieve the advantages noted herein. Indeed, the present disclosure can be easily retrofitted into the vast majority of existing bilge systems already installed on existing watercraft and then continue to use the in-place existing bilge pumps. This includes bilge pumps with integrated water switches as well as pumps using separate "float" style water switches.

This applicability significantly expands the quantity of watercraft that can benefit from the present disclosure. This is especially important when considering the safety issues associated with traditionally undiscovered failures of bilge pumps. The ability to economically bring the advantages of the present disclosure to existing watercraft and their existing bilge pumps can substantially improve the safety of in-service vessels at a cost more likely to be within the reach of their owners.

Figure 14:
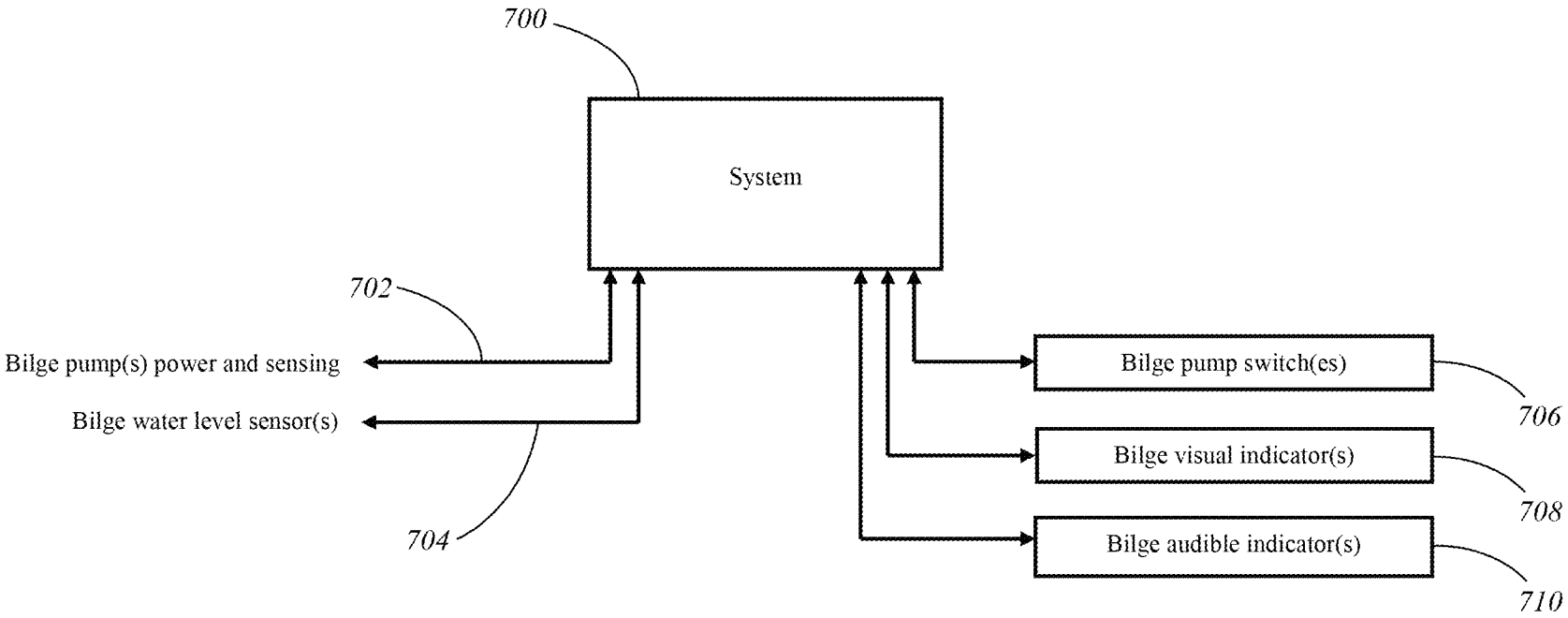
FIG. 14 is a block diagram of a pump control system with connections to associated components.

FIG. 14 illustrates one embodiment of the present disclosure. System 700 interacts with bilge pump power and sensing signals via connection 702, and with bilge water level sensors via connection 704. In some embodiments, system 700 will comprise processing circuitry similar to that extensively described earlier with respect to ballast pump systems and monitoring. Such processing circuitry can include memory for storing data associated with the bilge pumps and the bilge compartments, including motor current and motor voltage values, elapsed time to drain bilge compartments, and other parameters.

Continuing with FIG. 14, system 700 also supports user interfaces comprising manual switches 706, visual indicators 708, and audible indicators 710 at the watercraft console or other locations. Indicators 708 and 710 can comprise indications of bilge pump conditions and/or bilge compartment conditions. One embodiment can provision system 700 as a standalone bilge pumping system. Other embodiments can provision system 700 in combination with other systems or components.

Attention is directed to U.S. patent application Ser. No. 15/296,621, filed Oct. 18, 2016, titled "Wakeboat Hull Control Systems and Methods", pending, which is a continuation of U.S. patent application Ser. No. 14/450,828, filed Aug. 4, 2014, now U.S. Pat. No. 9,499,242, which in turn is a continuation of U.S. patent application Ser. No. 13/543,686, filed Jul. 6, 2012, now U.S. Pat. No. 8,798,825, all of which are incorporated herein by reference.

In compliance with the patent statutes, the subject matter disclosed herein has been described in language more or less specific as to structural and methodical features. However, the scope of protection sought is to be limited only by the following claims, given their broadest possible interpretations. The claims are not to be limited by the specific features shown and described, as the description above only discloses example embodiments.

I claim:

1. A pump assembly for pumping a level of fluid from a surface to be drained, the pump assembly comprising:

a pump intake adapter with an intake surface, the intake surface including a portion that in operation does not contact the surface to be drained, and creates an open conduit between the pump intake adapter and the surface to be drained through which fluid may flow;

a connection on the pump intake adapter to convey the fluid away from the pump intake adapter, the connection being in fluid communication with the open conduit;

a pump coupled to the connection on the pump intake adapter to convey the fluid away from the pump intake adapter; and processing circuitry configured to control the pump.

2. The pump assembly of claim 1 further comprising a hose coupling the pump to the connection on the pump intake adapter.

3. The pump assembly of claim 1 wherein the processing circuitry further comprises a user interface comprising at least one of manual switches, visual indicators, and audible indicators.

4. The pump assembly of claim 1 wherein the processing circuitry further comprises at least one computer interface.

5. The pump assembly of claim 4 further comprising a memory device coupled to the computer interface.

6. The pump assembly of claim 4 further comprising a tablet computer coupled to the computer interface.

7. The pump assembly of claim 1 wherein the processing circuitry further comprises a display.

8. The pump assembly of claim 1 wherein the pump intake adapter further comprises a water sensor.

9. The pump assembly of claim 1 wherein the pump intake adapter is shaped to fit a specific location.

10. A method of manufacturing a pump assembly for pumping a level of fluid from a surface to be drained, the method comprising:

providing a pump intake adapter having an intake surface, the intake surface including a portion that in operation does not contact the surface to be drained, and creates an open conduit between the pump intake adapter and the surface to be drained through which fluid may flow;

providing a connection on the pump intake adapter to convey the fluid away from the pump intake adapter, the connection being in fluid communication with the open conduit;

providing a pump;

coupling the pump to the connection on the pump intake adapter to convey, in operation, the fluid away from the pump intake adapter;

providing processing circuitry configured to control the pump; and coupling the processing circuitry to the pump.

11. The method of claim 10 further comprising providing a hose and coupling the pump to the connection on the pump intake adapter using the hose.

12. The method of claim 10 wherein the processing circuitry further comprises a user interface comprising at least one of manual switches, visual indicators, and audible indicators.

13. The method of claim 10 wherein the processing circuitry further comprises at least one computer interface.

14. The method of claim 13 further comprising coupling a memory device to the computer interface.

15. The method of claim 13 further comprising coupling a tablet computer to the computer interface.

16. The method of claim 10 wherein the processing circuitry further comprises a display.

17. The method of claim 10 further comprising providing a water sensor, coupled to the processing circuitry, and configured to determine if there is liquid on the surface to be drained.

18. The method of claim 10 further comprising shaping the pump intake adapter to fit a specific location.

19. A method of manufacturing a pump assembly for pumping a level of fluid from a surface to be drained, the method comprising:

providing a pump intake adapter having an intake surface, the intake surface including a first surface configured to contact the surface to be drained, including a second surface configured to contact the surface to be drained, and including a third surface, between the first and second surfaces, that, in operation, does not contact the surface to be drained and that defines an open conduit, between the first surface and the second surface, through which fluid may flow;

providing a connection on the pump intake adapter to convey the fluid away from the pump intake adapter, the connection being in fluid communication with the open conduit;

providing a pump;

coupling the pump to the connection on the pump intake adapter for fluid communication between the pump and the pump intake adapter;

providing processing circuitry configured to control the pump; and electrically coupling the processing circuitry to the pump.

20. The method of claim 19 wherein the processing circuitry further comprises at least one computer interface for removably coupling an input device, having a user interface, to the pump.

* * * * *